US008011522B2

(12) United States Patent
Romão de Sousa

(10) Patent No.: US 8,011,522 B2
(45) Date of Patent: Sep. 6, 2011

(54) SYNTHETIC CLOSURE WITH MULTIPLE INTERNAL LAYERS, EACH LAYER HAVING A VARIABLE CROSS SECTION (VCS) ALONG THE CLOSURE LENGTH

(75) Inventor: José Joaquim Romão de Sousa, Oporto (PT)

(73) Assignee: EPOLI_Espumas de polietileno SA, Mindelo (PT)

( * ) Notice: Subject to any disclaimer, the term of this patent is extended or adjusted under 35 U.S.C. 154(b) by 1202 days.

(21) Appl. No.: 11/726,419

(22) Filed: Mar. 22, 2007

(65) Prior Publication Data

US 2008/0229569 A1 Sep. 25, 2008

(51) Int. Cl.
*B65D 39/00* (2006.01)
*B65D 39/18* (2006.01)

(52) U.S. Cl. ..... 215/364; 215/355

(58) Field of Classification Search ..... 215/355, 215/364

See application file for complete search history.

(56) References Cited

U.S. PATENT DOCUMENTS

| | | | | | |
|---|---|---|---|---|---|
| 34,227 | A | * | 1/1862 | Ames | 215/364 |
| 623,070 | A | * | 4/1899 | Bonwick | 215/364 |
| 700,043 | A | * | 5/1902 | Heard | 215/360 |
| 706,634 | A | * | 8/1902 | Blumer | 215/364 |
| 771,298 | A | * | 10/1904 | De Olairmont | 215/364 |
| 1,314,848 | A | * | 9/1919 | Bars | 215/294 |
| 2,169,194 | A | * | 8/1939 | Geyer et al. | 285/55 |
| 2,419,743 | A | * | 4/1947 | Taylor | 215/364 |
| 3,760,969 | A | * | 9/1973 | Shimamoto et al. | 215/247 |
| 4,091,136 | A | | 5/1978 | O'Brien et al. | |
| 4,826,029 | A | * | 5/1989 | Skoglie | 217/110 |
| 5,480,915 | A | | 1/1996 | Burns | |
| 5,496,862 | A | | 3/1996 | Burns | |
| 5,636,757 | A | * | 6/1997 | Porvaznik | 215/364 |
| 5,692,629 | A | | 12/1997 | Burns | |
| 5,710,184 | A | | 1/1998 | Burns | |
| 5,855,287 | A | | 1/1999 | Burns | |
| 5,904,965 | A | | 5/1999 | Noel et al. | |
| 6,127,437 | A | | 10/2000 | Burns | |
| 6,601,722 | B1 | * | 8/2003 | Litoux-Desrue et al. | 215/364 |
| 6,695,997 | B2 | * | 2/2004 | Yaniger | 264/45.9 |
| 6,796,449 | B2 | * | 9/2004 | Fragola | 215/364 |
| 2002/0180083 | A1 | | 12/2002 | Yaniger | |
| 2006/0006132 | A1 | * | 1/2006 | Lauer et al. | 215/355 |
| 2006/0073295 | A1 | * | 4/2006 | Angermaier | 428/35.7 |
| 2009/0039052 | A1 | * | 2/2009 | Galvez-Ramos | 215/356 |

FOREIGN PATENT DOCUMENTS

| | | | |
|---|---|---|---|
| DE | 100865 | C | 6/1898 |
| DE | 10241022 | A1 | 3/2004 |
| EP | 0629559 | A1 | 12/1994 |
| FR | 2879167 | A1 | 6/2006 |
| WO | WO-0158772 | A1 | 8/2001 |
| WO | WO-2007007368 | A2 | 1/2007 |

* cited by examiner

*Primary Examiner* — Anthony Stashick
*Assistant Examiner* — Niki M Eloshway
(74) *Attorney, Agent, or Firm* — Patton Boggs LLP

(57) ABSTRACT

A container closure includes an inner core having a non-cylindrical profile created by a variable longitudinal cross-sectional area. One or more outer layers concentrically surround the core and have a cross-sectional area inversely correlated to the inner core so that the overall container closure has an essentially cylindrical profile.

13 Claims, 15 Drawing Sheets

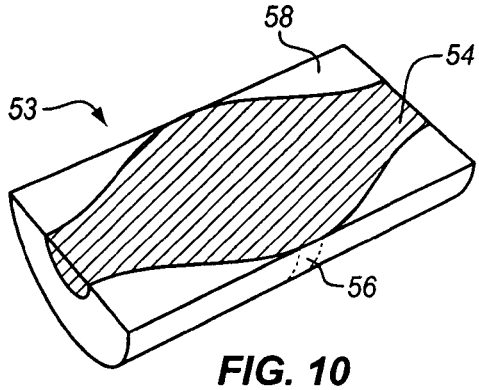
FIG. 10
FIG. 11
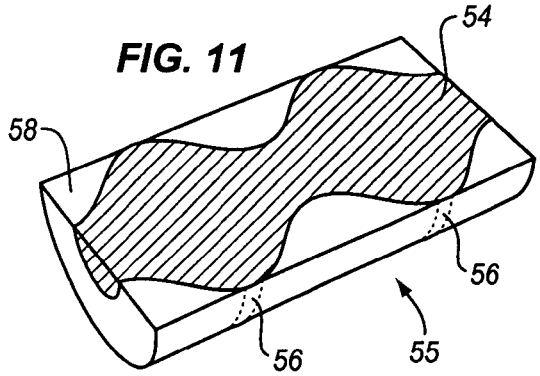
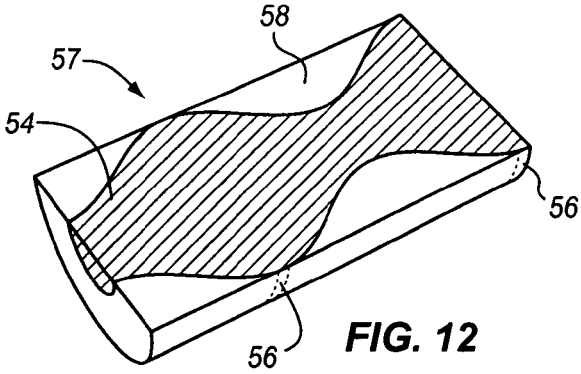
FIG. 12
FIG. 13
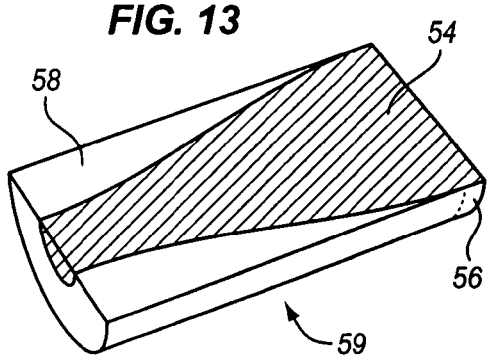

Sinusoid Configuration - Parameters A, B and C

A = sinusoid amplitude; B = sinusoid wave length; C = distance sinusoid axis to closure axis Wavelength (B) equal to closure length Wavelength (B) double of closure length Wavelength (B) half of closure length Wavelength Equal to Closure Length, Medium Amplitude Idem, Small Amplitude (A)

Idem, Large Amplitude (A)

Idem, Medium distance (C) between sinusoid and closure axis

Idem, Small distance (C) between sinusoid and closure axis

Idem, Large distance (C) between sinusoid and closure axis

SYNTHETIC CLOSURE WITH MULTIPLE INTERNAL LAYERS, EACH LAYER HAVING A VARIABLE CROSS SECTION (VCS) ALONG THE CLOSURE LENGTH

FIELD OF THE INVENTION

The invention relates generally to apparatus for closing containers, and, more particularly, to synthetic apparatus for achieving improved container closure properties. The invention relates to the development of new synthetic closures for glass bottles and in particular for wine bottles.

BACKGROUND OF THE INVENTION

Many products have specific or preferred container closure requirements and methods. In particular, products such as wines have strict requirements for container closures. Wine generally is sold in vertically-oriented bottles with a narrow circular opening at the top of the container. There are many requirements placed upon the closure systems for wine sold in bottles because of the delicate nature of the product. Due to the strenuous requirements for closure systems in wine bottles, most wine bottle closures traditionally have been produced from natural cork.

The use of natural cork container closures dates back to the $17^{th}$ century. A natural cork closure is produced from the outer bark of the cork oak species "Quercus Suber," a tree that is predominant around the Mediterranean Sea. Natural cork container closures have favorable properties attributed to a high density closed-cell structure, i.e., more than 20 million cells per $cm^3$, and a very thin cell wall, i.e., 1 to 2 microns. Natural cork also has excellent mechanical properties, namely compressibility and elasticity, which have made natural cork a material of choice for production of closures for wine glass bottles.

However, natural cork is not without limitations. For example, cork is available only in a specific geographic area and quantities are limited, causing prices to escalate. Furthermore, since natural cork is a natural product and subject to non-controllable climate conditions during the growth of the tree, cork shows a relatively high variation in properties, even within different quality sub-groups, namely, regarding its "oxygen transmission rate" (OTR). Additionally, natural cork is prone to develop a "cork taint" (rotten cardboard) smell and flavor linked to the presence of minute contamination with TCA (2,4,6-tricloranisole), which is believed to affect up to around 5% of all wine bottles.

These limitations promoted the development of "alternative container closures," which seek to overcome these limitations and/or emulate the best properties of cork.

Starting in the 1950s, "technical corks" were developed. Technical corks included "colmated" corks (filling in the surface voids of a lower quality natural cork with cork powder and a binder to improve surface homogeneity and reduce permeability), "agglomerated" corks (cork particles compressed together with a binder), 1+1 corks (an agglomerated cork with two cork discs, one on each side), etc. The technical corks were based on natural cork, but included additional manipulation to overcome some of the above limitations.

The early 1990s saw a technological discontinuity with the introduction of synthetic "plastic" container closures that used the same geometric configuration of the cork container closure, the same sealing mechanism for the same type of container (glass bottle), the same application (jaw clamping), and the same removal (cork screw) equipment. Later introductions included the "screw-cap", already extensively used for other beverages and also for sweet wines and liqueurs, with sealing done on the outside of the bottle neck. Outside sealing required different bottles and different bottling equipment.

These new container closures have consistently gained market share, initially among the "New World" wine producers and in young, fruity, white wines to be drunk within a year or two after bottling. New container closures have subsequently expanded the market to include more "long-term" types of wines.

In the eyes of many informed consumers, a cork container closure is still associated with a premium choice for high-quality wines (reds in particular) that are to be kept for a number of years. This segment is still largely untapped by synthetic container closures or screw caps.

Synthetic foamed plastic wine container closures have tried to overcome some of the above-mentioned limitations of the traditional cork closure.

In terms of the production processes, there are several main synthetic container closure families of products:

a. Injected container closures—obtained by a batch "injection-molding" process. These container closures are easily recognizable by a top and bottom surface finish that matches the finish on the cylinder side wall;
b. Extruded container closures—continuously extruded through an extruder die and length slit as required. These container closures usually have a more homogeneous structure and small cell size often visible on the top and bottom ends; and
c. Bead molded container closures—which are made by fusing foams beads together in a mold. These container closures have the advantage of retaining the appearance of natural cork. These closures have good compressive resistance because of a uniform cellular structure.

The overall performance of these synthetic container closures has progressively improved over the years, with the use of new thermoplastic materials, more elaborate compositions (density, two-layer sequential extrusion, etc.), and better control over the production process.

On the positive side, synthetic container closures are much more consistent than natural products, so synthetic closures generally exhibit lower standard deviation between different samples than same-quality natural cork container closures.

Obviously, all raw materials, such as polyolefins, block copolymers, ethylene copolymers, etc., are preferably organoleptic neutral, i.e., no taste or smell conferred upon or removed/scalped from the wine.

Some mechanical properties of a container closure are easily measured: compressibility, which affects insertion both on the usual bottling lines and for hand re-insertion after opening; expansion rate after insertion, which affects the immediate sealing properties and the manipulation time-lag after bottling; and relaxation force, which must be sufficiently large enough to guarantee a good seal but low enough for cork-screw removal.

Generally speaking, it is fair to say that, for the type of foamed materials currently being used for container closures, the higher the density the higher the "stiffness", i.e., a high density material is less compressible (or requires a larger compression force to achieve the same deformation), exhibits a higher relaxation force, and also requires a higher removal force. A "soft" low density container closure will be easier to insert and to remove but will show a smaller relaxation force (i.e., it will take longer to properly seal the bottle) and will probably show permanent deformation in the future. Thus, even based upon these purely mechanical performance evaluation criteria, there is a need to find an acceptable compromise between force (ease) of insertion and removal and good, fast, and permanent sealing properties.

A main limitation of plastic synthetic container closures is a relatively high oxygen transmission rate (OTR) through the closure and/or through the glass-closure interface. Different container closure materials and container closure designs show different OTRs; but it is now clear that, in general, synthetic container closures show a higher OTR than the best quality cork container closures or screw caps. This is the main reason why synthetic container closures have primarily captured the "young" wine market segment and have failed to obtain similar gains in wines kept for several years before opening.

For a foamed "plastic" container closure, the closure OTR is closely lined to the cell structure and density, with the actual closure material having only a limited influence on the final value. Different plastic materials have slightly different OTRs, but the density and the cell sizes primarily affect OTR.

Here again, for these foamed materials, a good OTR performance (low transmission rate) is substantially achieved with high density, i.e., hard, stiff container closures. Difficulties exist with creation of a low OTR plastic closure that also shows acceptable mechanical properties.

Choosing a container closure is no longer merely a way of sealing the wine in the bottle at the lowest possible cost. The container closure and the storage conditions determine the wine evolution in the bottle. A rewarding wine tasting experience after a certain period of time only materializes if all components that affect the wine evolution are coherently matched to the required and expected outcome.

Different container closures with different OTRs have a profound impact on the way a given wine evolves and develops over the years inside the bottle. Current theories in enology suggest that the role of an enologist does not end when wine is bottled, but extends until wine is served to a consumer. The kind of sensorial evolution that the wine goes through in the container is a major factor conditioning the consumer experience. Therefore, bottling conditions and all factors, including the container closure, affecting the sensorial evolution should be under direct control of the enologist. The selection and specific properties of the container closure preferably is a major responsibility of the enologist and may affect how the wine tastes when the container is opened. The choice of container closure has become critical to the future consumer experience. The choice of closure controls the slow oxidation, reduction, or polymerization reactions that a bottled wine goes through inside the bottle (all other conditions being equal—bottle size, temperature, temperature cycles, vertical or horizontal bottle keeping, etc.).

A "universal" container closure that equally suits all types of wine and all storage times is not practical. Different wines and different storage times need different closures with different OTRs, but all must show similar mechanical properties. The wine technologist/enologist must determine what OTR properties are required so an individual wine reaches optimum maturity levels after a specified number of years of storage under ideal conditions.

With such new requirements, several producers of synthetic container closures are starting to bring on the market different closures with different OTRs and trying to extend the suggested wine storage period. A lack of new advances in the field is limiting progress.

Another problem with developing container closures for the wine industry is the need for closures to withstand substantial pressure buildups that occur during storage of the wine product after bottling and sealing. During natural expansion of wine during hotter months, the pressure within bottles increases and imposes a burden upon the closure that must be resisted. Displacement of the closure out of the bottle must be prevented. As a result, a container closure must be capable of secure, intimate, frictional engagement with the bottle neck in order to resist any such pressure build ups.

In the wine industry, a secure sealed engagement of the closure with the neck of the bottle must be achieved virtually immediately after the closure is inserted into the neck of the bottle. During normal wine processing, the container closure is compressed, as detailed above, and inserted into the neck of the bottle to enable the closure to expand in place and seal the bottle. However, such expansion should occur immediately upon insertion into the bottle, since many processors tip the bottle onto its side or neck down after the closure is inserted into the bottle neck allowing the bottle to remain stored in this position for extended periods of time. If the closure is unable to rapidly expand into secure, intimate, frictional contact and engagement with the walls of the neck of the bottle, leakage will occur.

Container closures preferably are removed from a bottle using a reasonable extraction force. Although actual extraction forces extend over a wide range, generally accepted, conventional extraction forces are typically below 100 pounds. A balance must be achieved between secure sealing of a bottle and providing a reasonable extraction force for removal of the closure from the bottle. Since the requirements for these two characteristics are in direct opposition to each other, a careful balance must be achieved so that the closure is capable of securely sealing the wine in the bottle, preventing both leakage and gas transmission, while also being removable from the bottle without requiring an excessive extraction force.

Existing alternative systems are not adequate to satisfy the demanding requirements of the wine bottling industry. Thus, a need exists for improved synthetic closures for containers with improved closure properties. A new approach to the design of plastic closures is required.

BRIEF SUMMARY OF THE INVENTION

Embodiments of the present invention solve many of the problems and/or overcome many of the drawbacks and disadvantages of the prior art by providing a synthetic container closure with improved closure properties.

In particular, embodiments of the invention accomplish this by providing a synthetic container closure with a non-cylindrical inner core profile. Embodiments of the present invention preferably provide a container closure apparatus with an inner core with a non-cylindrical profile, an outer layer concentrically surrounding the inner core, and wherein the outer profile of the combined inner core and the outer layer is essentially cylindrical.

In preferred embodiments of the present invention, the inner core preferably includes a chemical composition or physical property distinct from the outer layer. The inner core and the outer layer preferably include at least one thermoplastic resin. The at least one thermoplastic resin preferably is selected from olefins, co-polymers of olefins, blends comprising olefins, styrenics, co-polymers of styrenics, blends comprising styrenics, and combinations of any of the foregoing. At least one thermoplastic resin preferably is foamed. The inner core and the outer layer preferably are extruded.

Embodiments of the present invention preferably include an inner core with a substantially sinusoidal longitudinal profile. The sinusoidal concept is specified in two dimensions by three parameters, namely, the sinusoid wave length, amplitude, and distance of the sinusoid axis to the container closure axis (See FIG. 21).

A wavelength of the substantially sinusoidal longitudinal profile preferably is substantially equal to a length of the container closure apparatus, approximately equal to multiples of the length of the container closure apparatus, approximately equal to a sub-multiple of the length of the container closure apparatus, and combinations thereof (See FIGS. 22A-22C). The sinusoid amplitude can vary between zero and the closure radius (See FIGS. 23A-23C). For the same wavelength and amplitude, the distance between the sinusoid axis and the closure axis can also vary substantially, but in this case is limited by the amplitude (See FIGS. 24A-24C). Depending on the different values of the amplitude and the wavelength, the inner core may have one or more maximum diameters at positions along the length of the container closure apparatus. Alternatively, the inner core may have an asymmetric longitudinal profile along the length of the container closure apparatus. The ratio of the diameters or cross-sectional areas of the first core and the second core along a longitudinal direction will also vary with the distance between the sinusoid axis and the closure axis, and preferably is varied depending on desired applications.

In preferred embodiments of the present invention, the container closure apparatus preferably is compressed and inserted into an opening of a container before releasing the compression force and allowing the container closure apparatus to expand and seal the opening of the container. Properties of the inner core and the outer layer preferably determine an extraction force required to remove the container closure apparatus from the opening of the container.

Embodiments of the present invention preferably have the compressibility and relaxation forces, extraction forces, and oxygen transmission levels through the container closure apparatus determined by the ratio of cross-sectional areas of the inner core to the outer layer and the composition and density of the inner core and the outer layer.

In preferred embodiments of the present invention, a length of the container closure apparatus preferably is cut into shorter longitudinal sections at predetermined lengths along the container closure apparatus.

Embodiments of the present invention may include one or more rings along the longitudinal length of the container closure apparatus created where the inner core extends to an outer edge of the container closure apparatus.

The invention provides a container closure comprising: an inner core with a non-cylindrical profile; one or more outer layers concentrically surrounding the inner core; wherein the outer profile of the combined inner core and the outer layers is substantially cylindrical. Preferably, the inner core comprises an inner core material having a chemical composition or physical property different from the chemical composition or physical property of the material of the one or more outer layers. Preferably, at least one of the inner core and the outer layer comprise at least one thermoplastic resin. Preferably, the at least one thermoplastic resin is selected from the group consisting of olefins, co-polymers of olefins, blends comprising olefins, and styrenics, co-polymers of styrenics, blends comprising styrenics, and combinations of the foregoing. Preferably, the at least one of the thermoplastic resins is foamed. Preferably, the container closure has a longitudinal cylindrical axis and wherein the composition of the inner core or at least one of the one or more outer layers varies longitudinally. Preferably, said inner core and the outer layer are extruded. Preferably, the cross-section of the inner core has a substantially sinusoidal longitudinal profile. Preferably, a wavelength of the substantially sinusoidal longitudinal profile is selected from the group consisting of: substantially equal to the length of the container closure, substantially equal to multiples of the length of the container closure, substantially equal to a sub-multiple of the length of the container closure, and combinations thereof. Preferably, the inner core has one or more maximum diameters at positions along the length of the container closure. Preferably, the inner core has an asymmetric longitudinal profile along the length of the container closure.

The invention also provides a method of closing a container, the method comprising: forming an inner core of a container closure; concentrically surrounding the inner core with one or more outer layers to form an essentially cylindrical container closure; and using the container closure to close an opening in a container. Preferably, the using comprises: compressing the container closure; inserting the container closure into an opening of a container, and releasing the compression and allowing the container closure to expand and seal the opening of the container. Preferably, one or both of the forming and concentrically surrounding comprises extruding. Preferably, the method further comprises cutting the extruded inner core and one or more layers into a one or more predetermined lengths to form the container closure. Preferably, the forming and concentrically surrounding comprises longitudinally varying the ratio of the cross-sectional area of the inner core and the cross-sectional area or areas of the one or more outer layers to determine one or more physical properties of the container closure. Preferably, the longitudinally varying determines one or both of a relaxation force of the container apparatus and an extraction force required to remove the container closure apparatus from the opening of the container. Preferably, the longitudinally varying determines oxygen transmission levels through the container closure. Preferably, the forming and concentrically surrounding comprises creating one or more rings along the longitudinal length of the container closure where the inner core extends to an outer edge of the container closure. Preferably, the at least one thermoplastic resin is foamed.

In another aspect, the invention provides a container closure comprising: an extruded inner core with a first composition with a variable cross-sectional area along a length of the container closure; an extruded outer layer with a second composition concentrically surrounding the inner extruded core; and wherein the outer profile of the extruded outer layer is essentially cylindrical. Preferably, the at least one thermoplastic resin is foamed.

In still another aspect, the invention provides a container closure comprising a cylindrical body having a longitudinal cylindrical axis wherein the body comprises a material the composition of which varies longitudinally. Preferably, the body comprises a core and one or more layers concentrically surrounding the core, and wherein the composition of at least one of the core and the one or more layers varies longitudinally. Preferably, at least one of the core and the one or more layers has a cross-sectional area that varies longitudinally. Preferably, the body comprises a first longitudinal portion having a first composition and a second longitudinal portion having a second composition. Preferably, the composition of the material varies continuously.

The invention provides a synthetic container closure which, for the first time, can be programmed for superior sealing properties for preservation and protection of the contents of the container without compromising on attributes such as ease of insertion and extraction, and which, at the same time, can be customized for different applications.

Additional features, advantages, and embodiments of the invention are set forth or are apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and, together with the detailed description, serve to explain the principles of the invention. In the drawings:

FIG. 10 is a longitudinal cross-sectional view of a container closure having a sinusoidal structure with a wavelength approximately equal to a container closure length;

FIG. 11 is a longitudinal cross-sectional view of a container closure having a sinusoidal structure with a wavelength approximately equal to one-half of a container closure length;

FIG. 12 is a longitudinal cross-sectional view of a container closure having a sinusoidal structure with a wavelength approximately equal to three-quarters of a container closure length;

FIG. 13 is a longitudinal cross-sectional view of a container closure having a sinusoidal structure with a wavelength approximately equal to double a container closure length;

DETAILED DESCRIPTION OF THE INVENTION

The present invention in some embodiments preferably provides a multiple component container closure with different cross-sections along the container closure length. In these embodiments, each component of the container closure preferably act in an optimized manner to balance oxygen transmission rate (OTR) with sealing ability, ease of insertion, removal, and reinsertion. Other embodiments of the present invention preferably "un-couple" the different conflicting requirements so that the overall performance of such a container closure is preferably a combination of different optima.

For cost-effective production of such a container closure, embodiments of the present invention preferably is compatible with continuous extrusion. Batch insertion of add-ons or other different components like discs or foils is more complex and thus more costly.

Thus, an object of the present invention is to provide a generally cylindrical container closure made up of more than one adjacent, non-cylindrical, internal profiles, with different properties, densities, etc., so that a continuous range of container closure properties can be obtained simply by manipulating geometric parameters of the container closure design, namely, along the container closure length.

In this way, it is possible to combine the best of the previously-mentioned conflicting objectives and develop a container closure that not only excels in each individual property, but also allows continuous variation in container closure properties, i.e., both OTR and mechanical properties. This creates a customer-tailored product without significant additional material costs or machinery setup times.

The present invention preferably also allows the creation of container closure zones of very high closure-glass sealing ability producing local high relaxation forces without exceeding the generally accepted overall compressibility requirements. These container closures can still be used with the standard insertion equipment and still achieve standard removal forces. This preferably is true even for bottle necks with extensive "barrel" deformation.

Variable geometry design preferably also allows the production of a controllable, continuously variable, and tailor-made container closure OTR.

Figure 1:
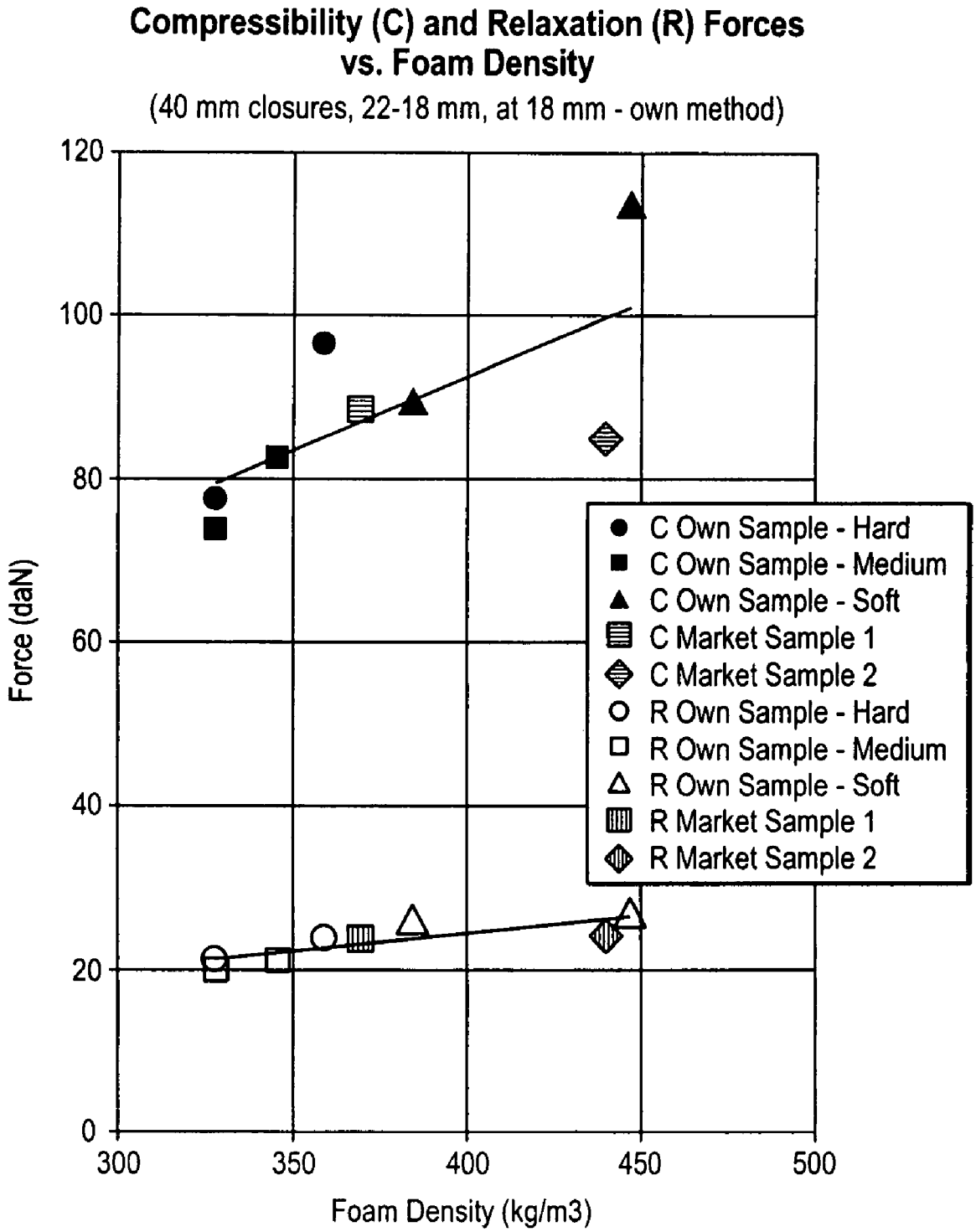
FIG. 1 is a graph of compressibility and relaxation forces versus foam density.
Figure 2:
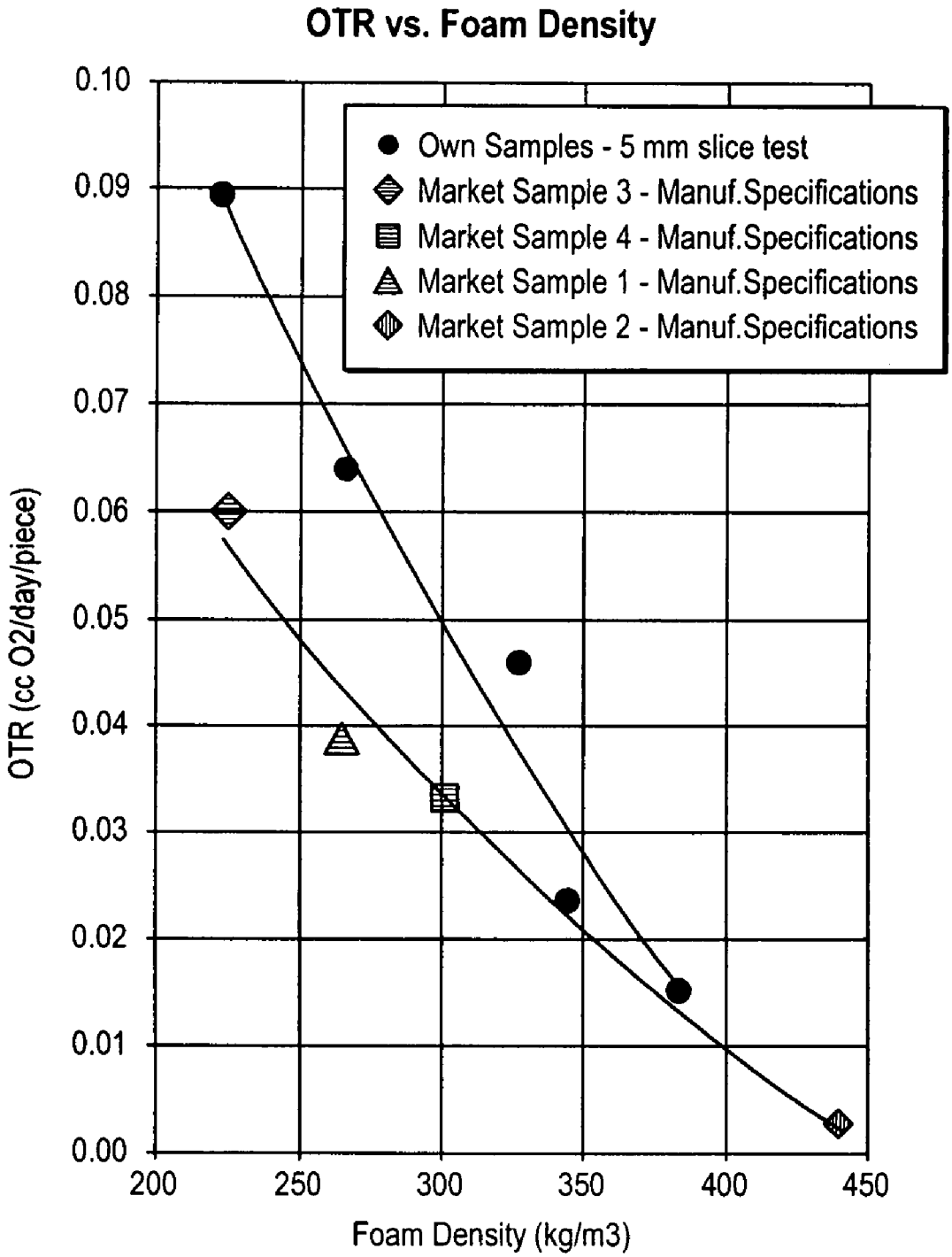
FIG. 2 is a graph of oxygen transmission rate versus foam density.

FIG. 1 is a graph of compressibility and relaxation forces versus foam density. FIG. 2 is a graph of oxygen transmission rate versus foam density.

The enhanced properties of the variable cross-section concept container closure versus the same-density homogeneous container closure will become clear if the following experimental/calculated properties are considered. In this disclosure "homogeneous", when applied to a container closure, means that the composition of the material and the density of the material is uniform throughout the container closure.

As an example, take the "barrel" configuration, as represented in FIGS. 8A-8E, with the sinusoid wavelength equal to the container closure length, a 400 kg/m$^3$ inner core, and a 320 kg/m$^3$, i.e., less dense, outer layer. Different sinusoidal amplitudes with all other parameters being equal can give different proportions of the inner core and outer layer compounds.

Figure 3:
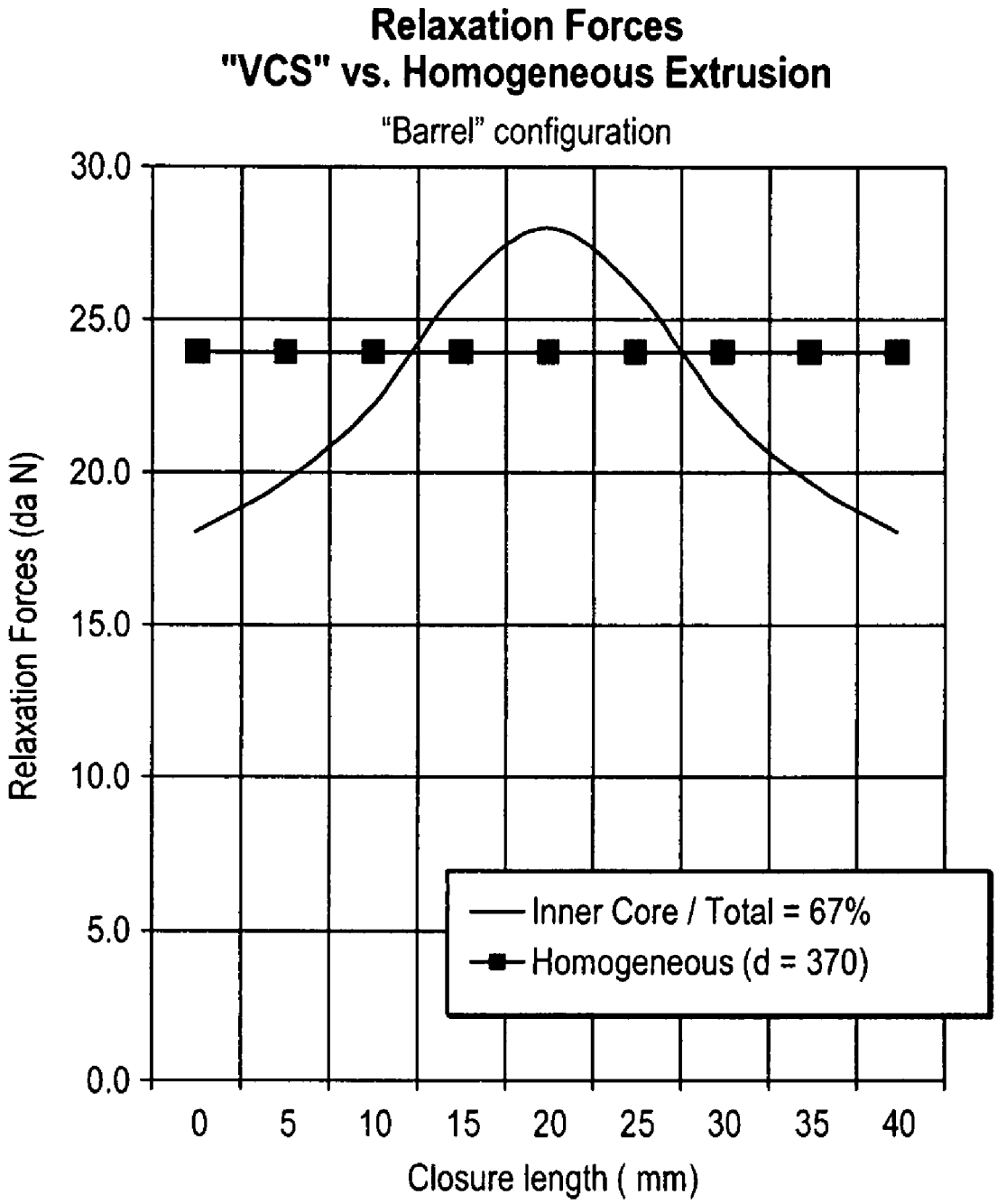
FIG. 3 is a graph of relaxation forces in a variable cross-section device versus a homogenous extrusion device.

A first container closure was configured with an inner core comprising 67% of the weight of the container closure and an outer layer comprising 33% of the weight of the container closure, which results in an average density of 370 Kg/m$^3$. The relaxation force along the container closure length varied from a maximum of 28 daN at the middle section, with a thicker harder inner core, to minimum of 18 daN at both ends of the container closure, as represented by the curved line on FIG. 3. A second container closure was configured with a homogenous structure and having of the same 370 Kg/m$^3$ density. This second container closure showed a constant relaxation force along the container closure length of 24 daN, as shown by the horizontal line in FIG. 3. The variable cross-section shape of the first configuration provides a higher relaxation force in the middle section than a corresponding same density homogeneous counterpart. This provides an improved local sealing "ring." At the same time, this first configuration also provides lower relaxation and compressibility forces at both ends of the container closure. Lower relaxation and compressibility enable easier insertion and re-insertion of the container closure in the bottle neck.

Figure 4:
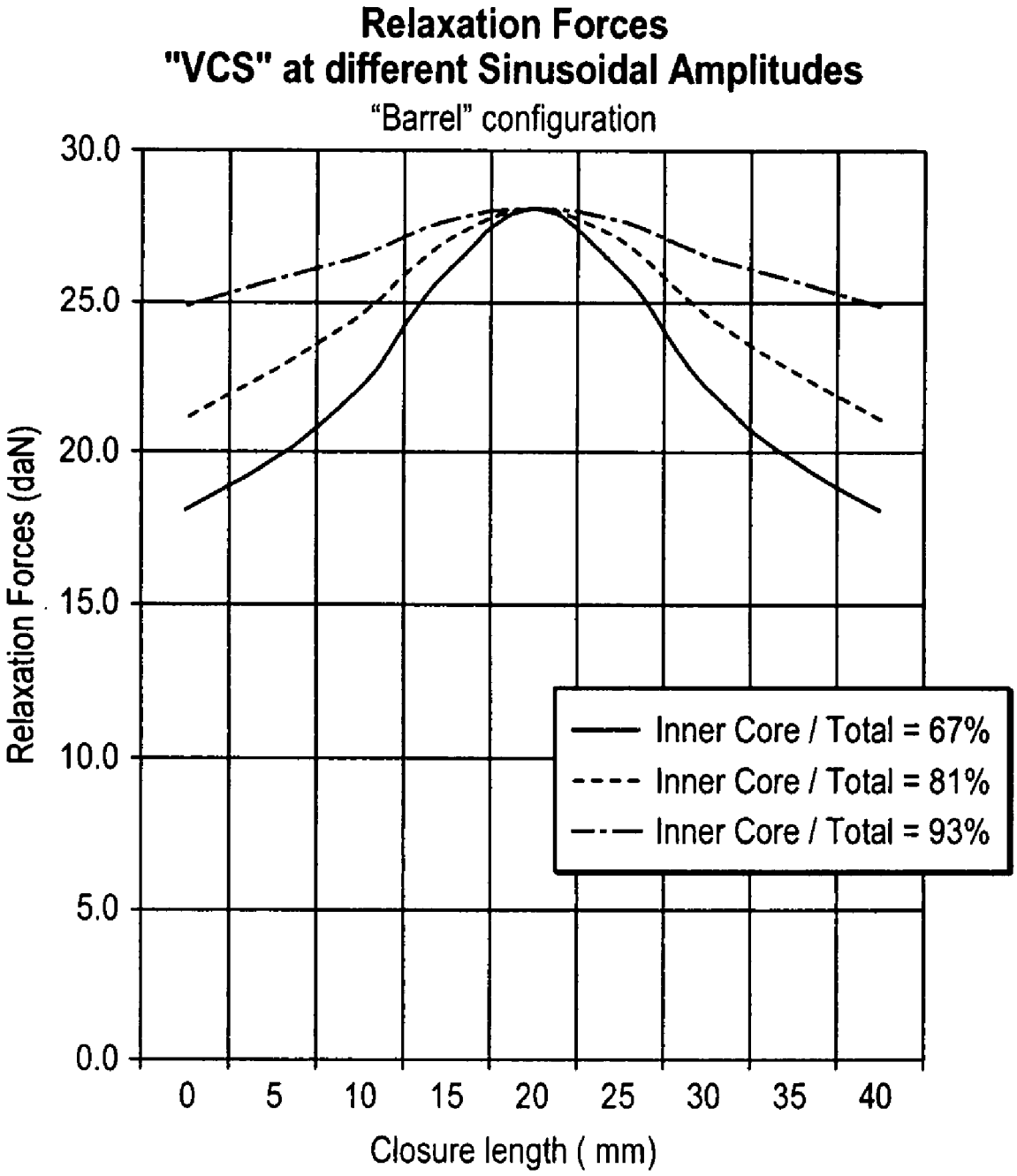
FIG. 4 is a graph of relaxation forces in a variable cross-section device at different sinusoidal amplitudes.

In this same "barrel" configuration, different sinusoid amplitudes have different proportions of the inner core and outer layer. This leads to essentially the same relaxation force and sealing properties in the middle section, but different compressibility and relaxation forces at both ends. FIG. 4 represents two additional examples with different proportions between inner core and outer layer: 81-19 (382 Kg/m$^3$) and 93-7 (393 kg/m$^3$). Note that the homogeneous relaxation forces in these two cases, horizontal lines not represented, are 26 daN and 27 daN, respectively, because each average density is different and both are higher than the first case 370 kg/m$^3$.

The sealing "enhancement," is better for the first container closure with the high amplitude sinusoid variable cross-section (higher percentage of the low density outer compound, or lower average container closure density) than for the second container closure with the constant cross-section having the same foam density. This is because the first container closure has the high-density inner ring of the barrel located where it makes the most difference as compared to the constant cross-section having the same foam density design.

Figure 5:
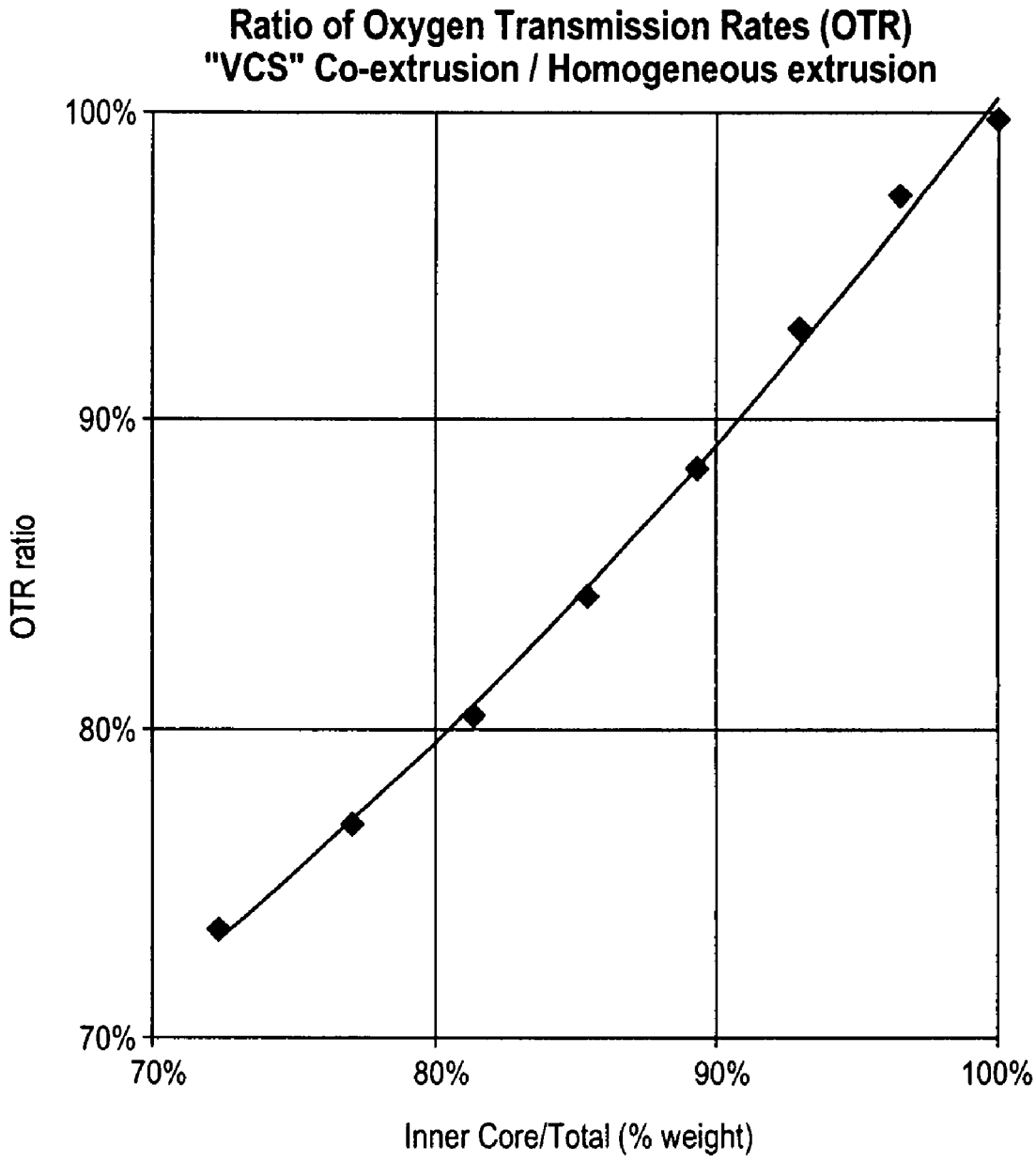
FIG. 5 is graph of the ratio of oxygen transmission rates in a variable cross-section device versus a homogenous extrusion device.

Similar conclusions are reached regarding first and second container closures' OTRs. FIG. 5 represents the ratio of OTRs of first and second container closures. The OTRs of the homogeneous second container closure with the constant cross-section having the same foam density were experimentally measured by a 5 mm slice test, and the OTRs for the first container closure with the high amplitude sinusoid variable cross-section (higher percentage of the low density outer compound, or lower average container closure density were calculated for the average density in each container closure section. FIG. 5 shows that the first container closure with the variable cross-section configuration generally improves/lowers the container closure OTR. Again, the enhancement being larger with higher sinusoid amplitudes. For example, an 80-20 inner core-outer layer proportions configuration will have about 79% of the OTR of a container closure with a constant cross-section having the same density, thus a 21% improvement.

In general, all other factors being equal, namely, material composition and density of each inner core and outer layer, compressibility and relaxation forces and OTR depend on the geometric configuration. Thus, with geometric configuration control, it is possible to simultaneously improve container closure OTR and compressibility and relaxation forces in relation to the previous homogeneous or constant cross-section container closure.

Embodiments of the present invention preferably allow the continuous production of synthetic container closures of reproducible constant properties, tailor-made to the specifications of the wine technologists in all of the previously discussed issues, based on an internal design that combines geometric parameters for two or more interior different compounds to the other variables currently taken into consideration for single layer or coated rod extrusion, such as compound formulation, density, etc.

Figure 6A:
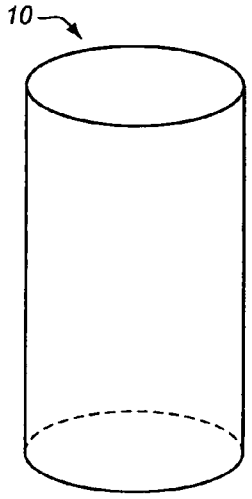
FIG. 6A PRIOR ART
FIG. 6A is a perspective view of a solid, homogenous prior art container closure.

Embodiments of the present invention are described with reference to the figures. FIG. 6A is a perspective view of a container closure 10 with a solid, homogenous composition.

Figure 6B:
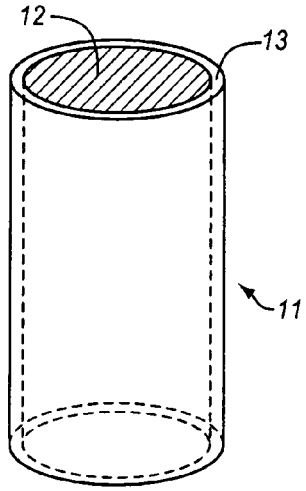
FIG. 6B PRIOR ART
FIG. 6B is a perspective view of a prior art container closure with a cylindrical inner core surrounded by a very thin outer layer.
Figure 6C:
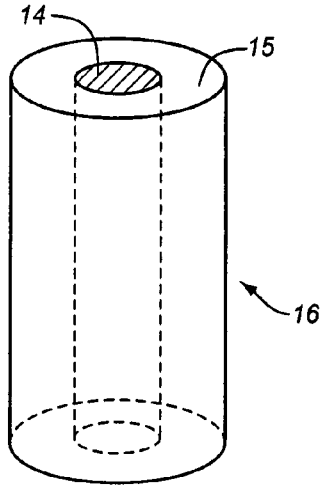
FIG. 6C is a perspective view of a co-extruded container closure with a cylindrical inner core surrounded by an outer layer.

FIG. 6B is a perspective view of a container closure 11 having an inner core 12 and a thin outer layer 13. FIG. 6C is a perspective view of a container closure 16 with a core 14 surrounded by an outer layer 15. The inner core 14 is cylindrical and is surrounded by a cylindrical outer layer 15.

Various exemplary embodiments of the invention are shown in FIGS. 7A through 20. General features, materials, and properties of the container closure according to the invention are discussed in connection with the first several exemplary container closures, such as 17 or 29, though it should be understood that any such discussion also applies to other embodiments of the invention, including, but not limited to, the embodiments described below.

Figure 7A:
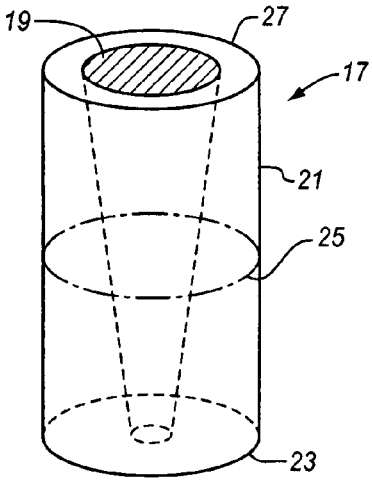
FIG. 7A is a perspective view of a container closure showing a tapered inner core of the container closure.
Figure 7B:
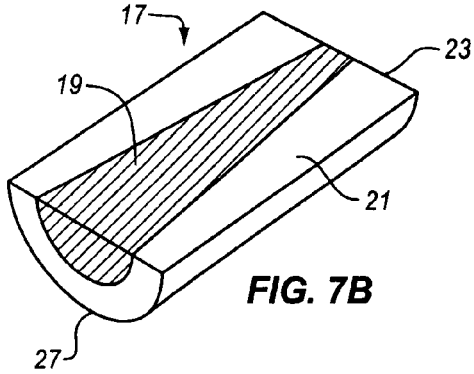
FIG. 7B is a cutaway view of the container closure of FIG. 7A.
Figure 7C:
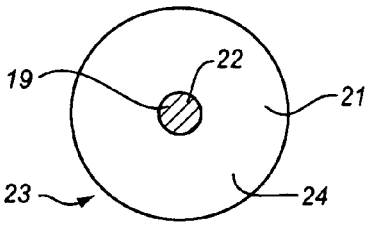
FIG. 7C is an end view of the container closure of FIG. 7A at a first end of the container closure.
Figure 7D:
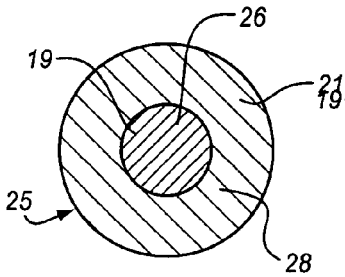
FIG. 7D is a cross-sectional view of the container closure of FIG. 7A at a central point along the container closure.
Figure 7E:
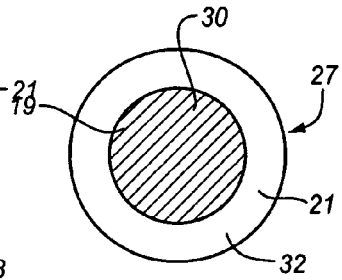
FIG. 7E is an end view of the container closure of FIG. 7A at a second end of the container closure.

The embodiment shown in FIGS. 7A-7E includes a tapered inner core 19 and a corresponding inversely tapered outer layer 21 for creating the overall substantially cylindrical container closure 17. The inner core 19 of the container closure 17 preferably has an increasing smaller profile as one proceeds longitudinally from a first end 23 (FIG. 7C) through a central region 25 along the longitudinal axis (FIG. 7D) and to an opposite end 27 (FIG. 7E). The inner core 19, in this embodiment, has a generally conical or truncated conical shape. As can be seen by comparing FIGS. 7C, 7D, and 7E, the ratio of the cross-sectional area of the inner core 19 to the cross-sectional area of the outer layer 21 varies longitudinally, that is, along the length of the cylinder in the direction of the cylindrical axis. That is, the ratio of core area 22 to outer layer area 24 at end 23, shown in FIG. 7C is different than the ratio of core area 26 and outer layer area 28 at the central point, shown in FIG. 7D, which is different than the ratio of core area 30 to outer layer area 32 at end 27, shown in FIG. 7E.

Variable profiles of the inner core 19 allow for control of various properties of the container closure 17. For example, the inner core 19 preferably is denser and/or more rigid than the outer layer 21. Other relative densities and rigidities are possible. A generally conical or truncated conical inner core 19 preferably allows for improved insertion of the container closure 17 into a container. For example, the smaller proportion of a more dense and/or rigid inner core 19 at an end 23 of the container closure 17 preferably allows for easier compression of the end 23 that fits into the container. The asymmetrical compression of the container closure 17 preferably facilitates insertion of the container closure 17 into a container while maintaining sealing properties with the higher proportion of a more dense and/or rigid inner core at end 27 of the container closure 17.

The compositions of the inner core and outer layer may be varied longitudinally, along the length of the container closure. When this longitudinally varying composition is used, the invention contemplates that a simple cylindrical inner core 14 and correspondingly simple cylindrical outer layer 15 can be used to form a container closure 16 as shown in FIG. 6C. Preferably, the longitudinally varying profile as shown in the figures is combined with the longitudinally varying composition. Manipulating the composition and profiles of the inner core 14, 19 and the outer layer 15, 21 is used to determine desirable properties of the closure to determine oxygen transmission levels through the opening in a container sealed with the container closure 17. For example, oxygen transmission preferably occurs at higher or lower rates through the inner core 14, 19 or the outer layer 15, 21. If low oxygen transmission is desired, the proportion of the inner core 14, 19 to the outer core 15, 21 preferably is adjusted to increase the proportion of material with lower oxygen transmission properties. The oxygen transmission preferably is altered to create a desired wine evolution path while wine is in a container. Using embodiments of the present invention, container closure properties preferably are specifically selected to achieve a certain desired wine evolution after a specified storage time.

Compositional and/or geometric configuration of both the inner core 19 and the outer layer 21 and properties of the inner core 19 and the outer layer 21 can have substantial effect on both mechanical properties, i.e., relaxation and extraction forces, etc., and oxygen transmission rates. Other properties of the container closure 17 preferably similarly are adjusted by changing the proportion of the inner core 19 to the outer core 21 along the longitudinal length of the container closure 17, such as compressibility and relaxation.

Figure 8A:
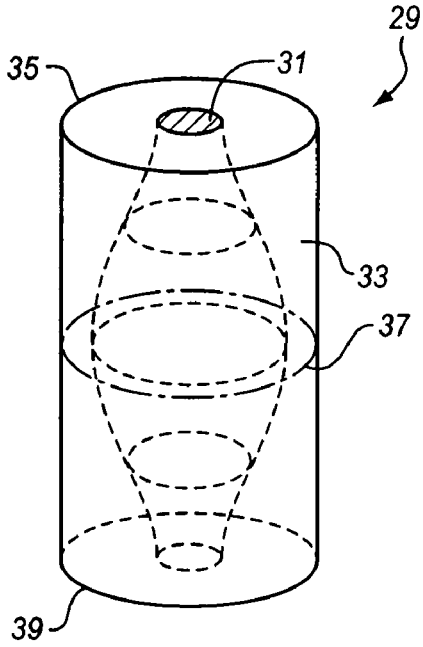
FIG. 8A is a perspective view of a container closure showing a sinusoidal-shaped structure of the container closure of the core and outer layer ("barrel" configuration)
Figure 8B:
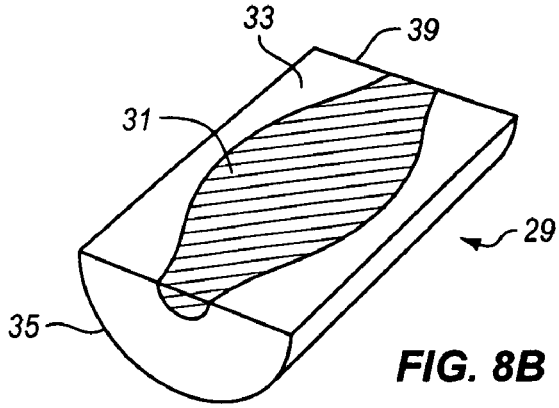
FIG. 8B is a cutaway view of the container closure of FIG. 8A.
Figure 8C:
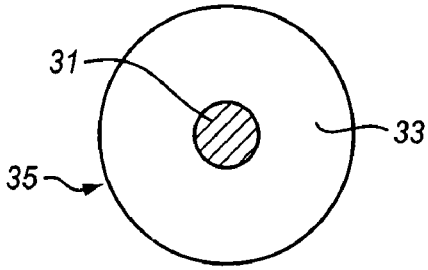
FIG. 8C is an end view of the container closure of FIG. 8A at a first end of the container closure.
Figure 8D:
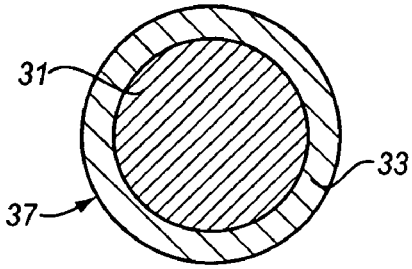
FIG. 8D is a cross-sectional view of the container closure of FIG. 8A at a central point along the container closure.
Figure 8E:
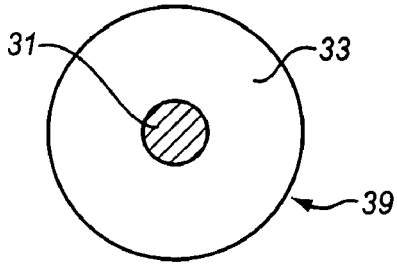
FIG. 8E is a cross-sectional view of the container closure of FIG. 8A at a second end of the container closure.

FIGS. 8A-8E show a container closure 29 with a variable cross-sectional area inner core 31 and a corresponding inverse variable cross-sectional area outer layer 33 for creating an overall substantially cylindrical container closure 29. The variable profile of the inner core 31 of the container closure 29 may increase from a narrow first end 35 (FIG. 8C) through a wider central region 37 along the longitudinal axis (FIG. 8D) before decreasing to a narrow opposite end 39 (FIG. 8E). An inner core 31 with a larger diameter profile in the center of the container closure 29 will preferably allow for improved insertion and reinsertion of the container closure 29 into a container and improved removal of the container closure 29 from the container. For example, the smaller proportion of a more dense and/or rigid inner core 31 at the end 35 of the container closure 29 preferably allows for easier compression of the end 35 that fits into the container. The compression profile of the container closure 29 preferably facilitates insertion of the container closure 29 into a container. Additionally, the smaller proportion of a more dense and/or rigid inner core 31 at the end 39 of the container closure 29 preferably allows for easier compression of the end 39 used for removal of the container closure 29 from the container by increasing flexibility and compression at the end 39 of the container closure 29 that receives the main extraction force.

The inner core 31 preferably has a non-cylindrical profile created by a variable longitudinal cross-sectional profile. The outer layer 33 preferably has a profile inversely correlated to the profile of the inner core 31 so that the overall container closure 29 has a substantially cylindrical profile. Herein, "substantially cylindrical" contemplates imperfections in the profile as well as intentional small variations from cylindrical, such as embodiments in which one or more longitudinal portions, such as one end or both ends, are made slightly larger or slightly smaller than another longitudinal portion. The overall cylindrical profile preferably is sized to fit a particular opening in a container. Preferably, the container closure 29 is designed to close and seal a wine bottle. However, the container closure design as disclosed in this patent can be used to seal other containers and for other uses. The inner core 31 and the outer layer 33 preferably are constructed of different materials with distinct properties or the same material with variable characteristics. For example, the inner core 31 can be constructed of an olefin or blends thereof and the outer layer 33 can be constructed of a styrenic or blends thereof. As another example, the inner core 31 may be constructed of an olefin made into a high density foam and the outer layer 33 may be constructed of an olefin made into a low density foam. In preferred embodiments of the present invention, one or both of the inner core 31 and the outer layer 33, or both, preferably are constructed of thermoplastic resins. The thermoplastic resins preferably are olefins, co-polymers of olefins, blends comprising olefins, styrenics, co-polymers of styrenics, blends comprising styrenics, and combinations of these resins. Other thermoplastic resins or similar materials preferably are used in embodiments of the present invention. The materials of the inner core 31 and the outer layer 33 preferably are chosen to achieve a desired neutral flavor/aroma scalping as well as a clean taste and smell neutrality of water/ethyl alcohol extraction performed on the container closures 29. If thermoplastic resins are used, the thermoplastic resins preferably are foamed or otherwise processed. The foam density preferably is altered by the processing of the thermoplastic resins.

The inner core 31 and the outer layer 33 preferably are extruded layers. In a preferred embodiment of the present invention, the inner core 31 and the outer layer 33 preferably are co-extruded in a concentric pattern on one another to create the container closure 29. Other processes for creation of the container closure 29 are contemplated.

Additional layers preferably are used during creation of a container closure. For example, if three layers were used, a first layer would be an inner core with a non-cylindrical profile. At least one, and preferably both, of the remaining layers preferably would be non-cylindrical in profile as well and preferably create an overall cylindrical profile when combined together. Preferably, each layer in a container closure has a variable cross-sectional area along a closure length while maintaining a substantially cylindrical outer cross-sectional area after combining all of the layers.

Once the container closure 29 has been created, the container closure 29 preferably is inserted into an opening of a container by traditional means. The container closure 29 preferably is placed in a jaw clamping member positioned above a container opening. The jaw clamping member may compress the container closure 29 to a diameter substantially less than its original diameter. Once the container closure 29 has been fully compressed, a plunger preferably moves the container closure 29 into the neck of the container. The compression force on the container closure 29 preferably is released and the container closure 29 preferably expands into engagement with an interior diameter of the container, creating a seal. The relaxation force preferably is the amount of force exerted by the container closure 29 against the neck of the container to create a seal. The compression and relaxation forces are preferably adjusted by altering the shapes of the inner core 31 and the outer layer 33, the composition of the inner core 31 and the outer layer 33, foam densities, and other configurations of the container closure.

The container closure 29 preferably allows removal of the closure from a container by using a reasonable extraction force. The extraction force is the amount of force required to remove the container closure 29 from the container. A seal preferably is created that prevents both leakage and gas transmission, while allowing removal of the container closure 29 from the container without requiring an excessive extraction force.

Figure 9A:
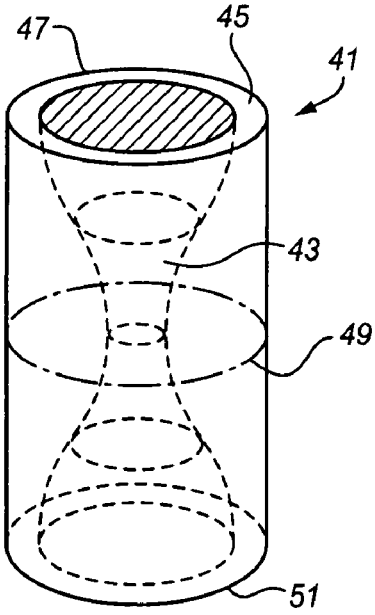
FIG. 9A is a perspective view of a container closure showing another sinusoidal structure of the container closure inner core and outer layer ("hour-glass" configuration)
Figure 9B:
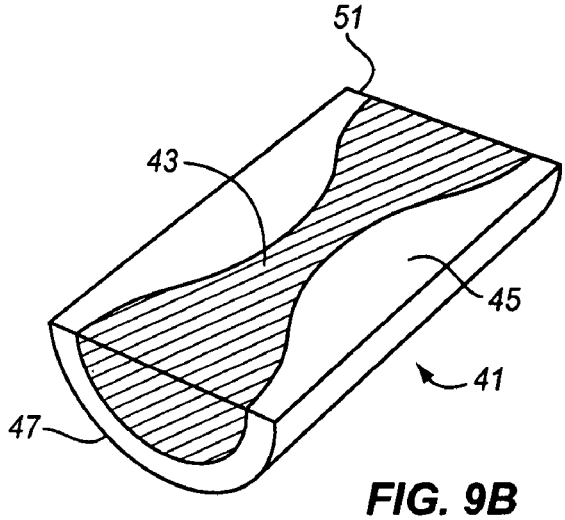
FIG. 9B is a cutaway view of the container closure of FIG. 9A.
Figure 9C:
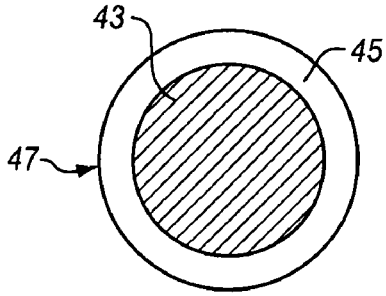
FIG. 9C is an end view of the container closure of FIG. 9A at a first end of the container closure.
Figure 9D:
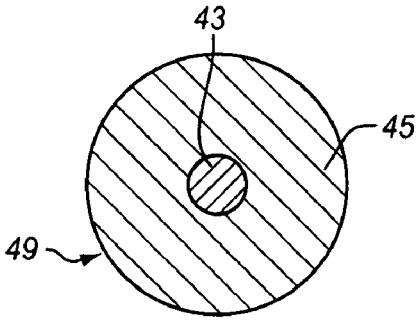
FIG. 9D is a cross-sectional view of the container closure of FIG. 9A at a central point along the container closure.
Figure 9E:
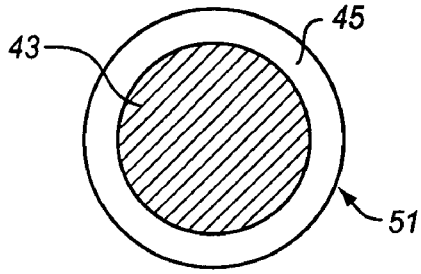
FIG. 9E is an end view of the container closure of FIG. 9A at a second end of the container closure.

FIGS. 9A-9E show a container closure 41 with a variable inner core 43 and a corresponding outer layer 45 for creating an overall substantially cylindrical container closure 41. The inner core 43 of the container closure 41 preferably varies from a wide first end 47 (FIG. 9C) through a narrow central region 49 along the longitudinal axis (FIG. 9D) and to a wider opposite end 51 (FIG. 9E). An inner core 43 narrower at a center region 49 of the container closure 41 preferably allows for improved sealing properties at both ends of the container closure 41. The container closure 41 preferably has a wider first end 47 and a wider opposite end 51 to form multiple rigid seals with a container. For example, a larger proportion of a more dense and/or rigid inner core 43 at the first end 47 and the opposite end 51 of the container closure 41 preferably allows for secure seals at either end of the container closure 41 and prevent unwanted oxygen transmission to and from the contents of the container.

During the creation of container closures, the shape of an inner core cross-sectional area preferably is varied based upon a sinusoidal function. Other patterns of variation preferably are used, such as step functions or other similar functions. Sinusoidal configurations are preferable due to manufacturing considerations, but other configurations are possible. The wavelength of the sinusoidal longitudinal shape preferably is varied for creating distinct properties for the container closures. The sinusoidal longitudinal profile preferably has one or more amplitude maximums yielding different maximum core diameters at different positions relative to a length of the container closure. The wavelength of the sinusoidal longitudinal shape preferably is substantially equal to the length of the container closure, approximately equal to multiples of the container closure length, approximately equal to a sub-multiple of the length of the container closure, and/or combinations or variations. For example, FIG. 10 is a longitudinal cross-sectional view of a container closure 53 with wavelength approximately equal to a container closure length. FIG. 11 is a longitudinal cross-sectional view of a container closure 55 with wavelength approximately equal to one-half of a container closure length. FIG. 12 is a longitudinal cross-sectional view of a container closure 57 with wavelength substantially equal to three-quarters of a container closure length. FIG. 13 is a longitudinal cross-sectional view of a container closure 59 with wavelength approximately equal to double a container closure length.

As seen in FIGS. 10-13, each time an inner core 54 reaches the outside of the container closures 53, 55, 57, 59, the inner core 54 preferably is formed with a ring 56 that will be in contact with a container when the closure is used. The one or more rings 56 on each container closure 53, 55, 57, 59 preferably create variable sealing properties due to the variations in materials between the inner core and outer layer. If the inner core 54 has a different density or rigidity than the outer layer 58, then the seal between the container closure 53, 55, 57, 59 and the container preferably is altered.

Figure 14:
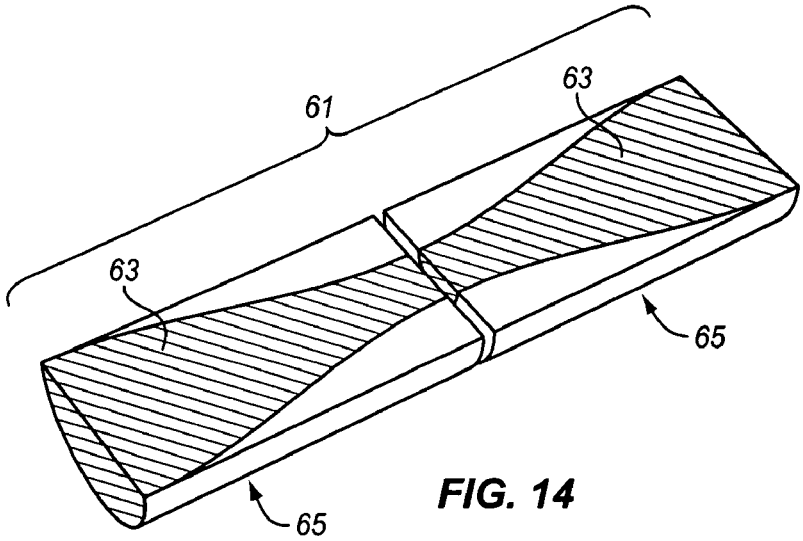
FIG. 14 is a longitudinal cross-sectional view of a longer section of extruded container closure cut to create two identical container closures as shown in FIG. 7A.

FIG. 14 is a longitudinal cross-section of a longer section of extruded container closure cut to create two identical container closures as shown in FIG. 13. The container closures generally are extruded in long sections 61 with sinusoidal or other patterns of an inner core 63. The long sections 61 of extruded container closure are then cut at predetermined lengths to create individual container closures 65 sized for particular applications. Preferably, the long sections of extruded container closure preferably are cut such that a desired profile of the inner cores is identical for each individual container closure.

Figure 15:
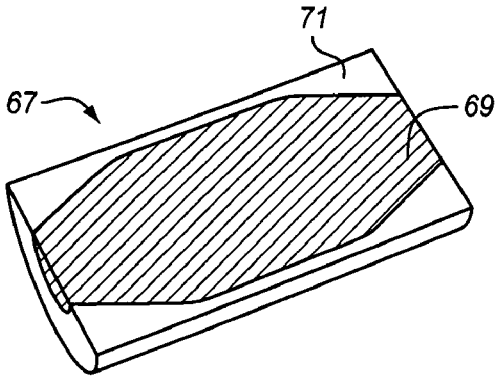
FIG. 15 is a longitudinal cross-sectional view of a container closure with a non-sinusoidal wave amplitude which is less than the radius of the container 67.

FIG. 15 is a longitudinal cross-sectional view of a container closure 67 with a non-sinusoidal wave amplitude which is less than the radius of the container closure 67. The amplitude of an inner core 69 in this embodiment does not extend to an outer surface of the container closure 67. In this case, the inner core 69 preferably is covered by outer layer 71.

Figure 16:
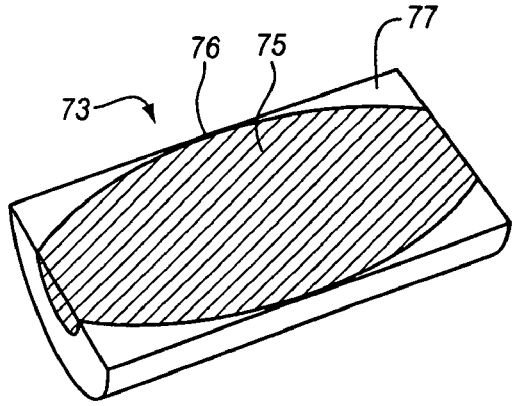
FIG. 16 is a longitudinal cross-sectional view of a container closure with wave amplitude approximately equal to the radius of the container closure.

FIG. 16 is a longitudinal cross-sectional view of a container closure 73 with wave amplitude approximately equal to the radius of the container closure 73. The wave amplitude of an inner core 75 preferably extends to an outer surface of the container closure 73. In this embodiment, the inner core 75 will not be covered by outer layer 77 in the region 76.

Figure 17:
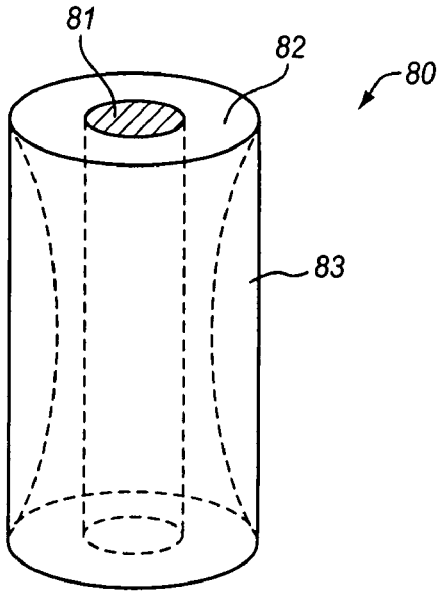
FIG. 17 is a perspective view of a container closure according to the invention with an inner core and two outer layers.

FIG. 17 is a perspective view of a container closure 80 according to the invention with an inner core 81 and two outer layers 82 and 83. In this embodiment, inner core 81 is cylindrical, first outer layer 82 has a sinusoidal profile that may be termed an hour-glass profile, and second outer layer 83 has a profile that is the inverse of the profile of first outer layer 82, with the result that the outer profile of container closure 80 is substantially cylindrical.

Figure 18:
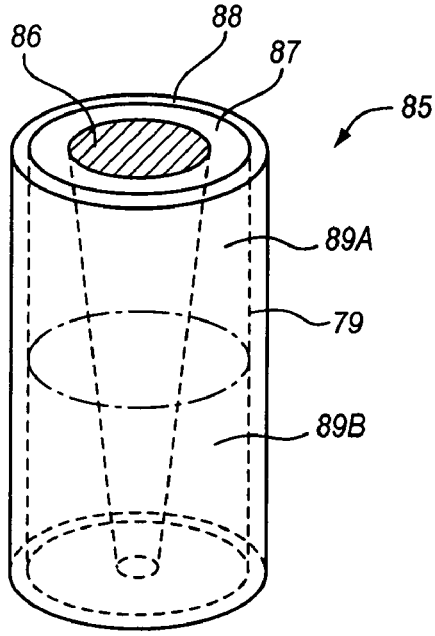
FIG. 18 is a perspective view of a container closure according to the invention with an inner core and two outer layers in which the composition of one layer varies longitudinally.

FIG. 18 is a perspective view of a container closure 85 according to the invention with an inner core 86 and two outer layers 87 and 88, in one (87) of which the composition varies longitudinally. In container closure 85, core 86 is tapered similarly to the embodiment of FIG. 7, first outer layer 87 has an inverse profile such that the outer surface is essentially cylindrical, and second outer layer 88 is a thin skin 88, preferably a skin that protects the inner layers and/or interacts with the bottle walls in an optimum manner. Second outer layer 88 has two portions 89A and 89B which have different compositions.

Figure 19:
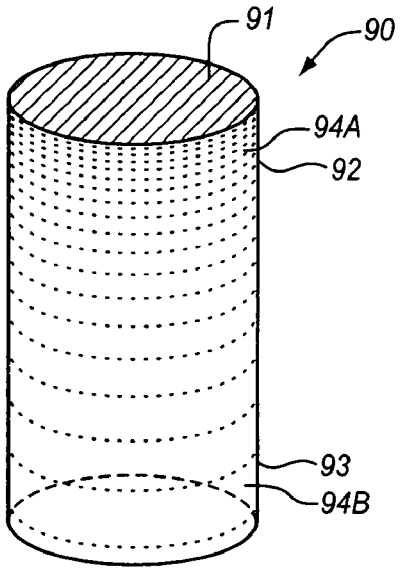
FIG. 19 is a perspective view of a container closure according to the invention in which the composition of the closure varies continuously longitudinally.

FIG. 19 is a side perspective view of a container closure 90 according to the invention in which the composition of the closure varies continuously longitudinally. In this example, closure 90 has only a core layer 91. Core layer 91 has a composition 94A at one end 92 and another composition 94B at the other end 93, and in between varies gradually and in a continuous manner from a composition that is primarily the composition 94A to a composition that is primarily composition 94B. In the preferred embodiment, one composition 94A is a relatively pliable, relatively low bulk density foamed resin; and the other composition 94B is a resin significantly less pliable with a higher bulk density, or the chemical composition of the resins of the core could change to achieve different results and different properties.

Figure 20:
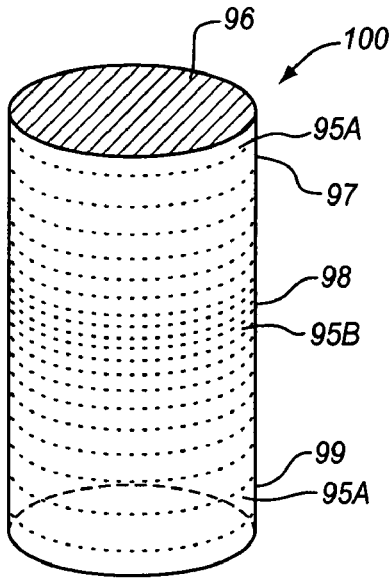
FIG. 20 is a perspective view of a container closure according to the invention in which the composition of the closure varies continuously longitudinally according to a sinusoidal function.
Figure 21:
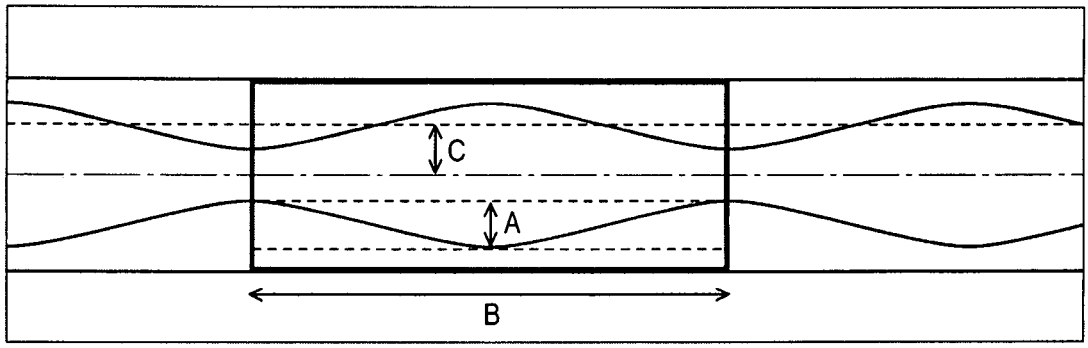
FIG. 21 is a cross-sectional view of a sinusoidal configuration showing parameters A, B, and C.
Figure 22A:
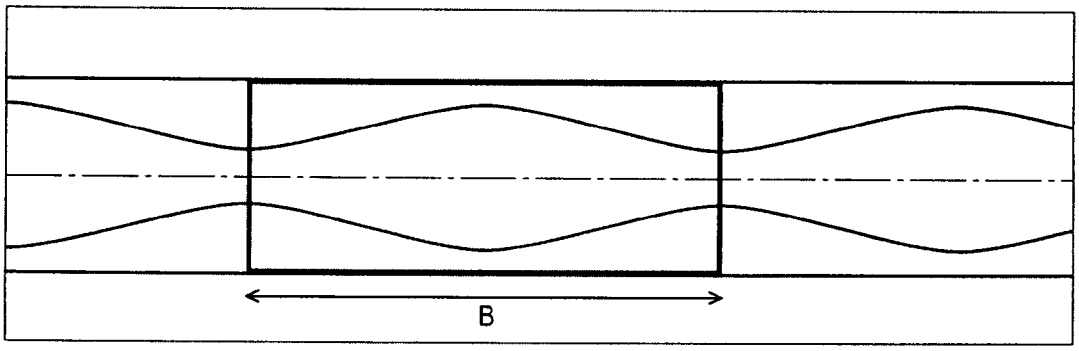
FIG. 22A is a cross-sectional view of a sinusoidal configuration with wavelength (B) equal to container closure length.
Figure 22B:
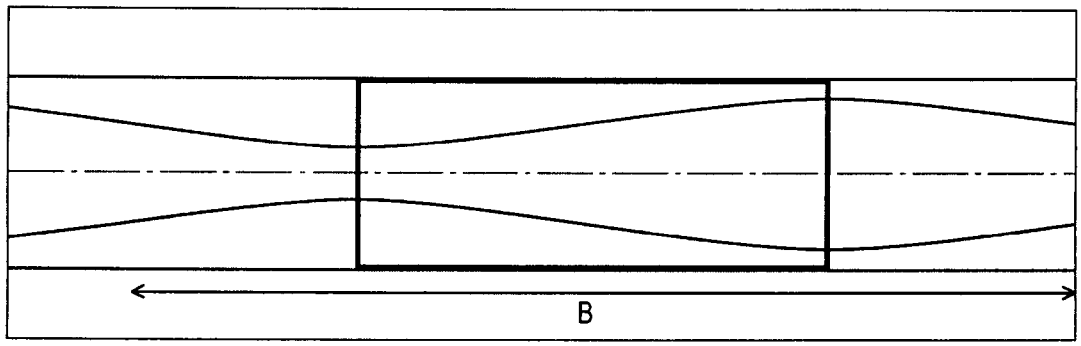
FIG. 22B is a cross-sectional view of a sinusoidal configuration with wavelength (B) equal to double the container closure length.
Figure 22C:
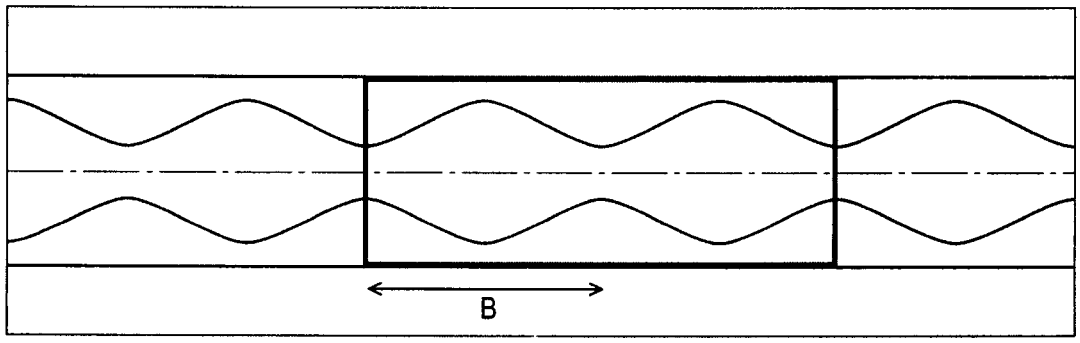
FIG. 22C is a cross-sectional view of a sinusoidal configuration with wavelength (B) equal to half the container closure length.
Figure 23A:
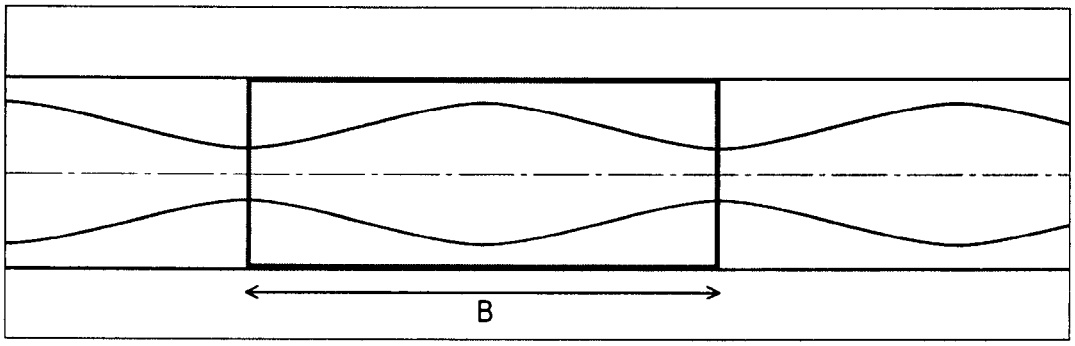
FIG. 23A is a cross-sectional view of a sinusoidal configuration with wavelength equal to the container closure length with a medium amplitude (A)
Figure 23B:
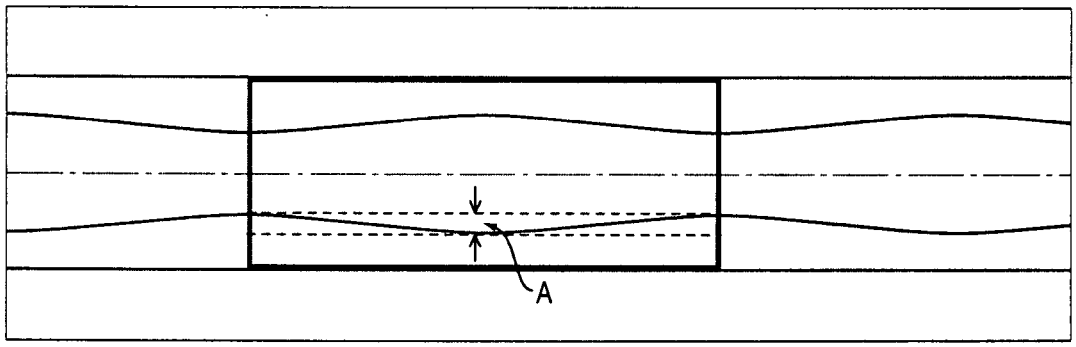
FIG. 23B is a cross-sectional view of a sinusoidal configuration with wavelength equal to the container closure length with a small amplitude (A)
Figure 23C:
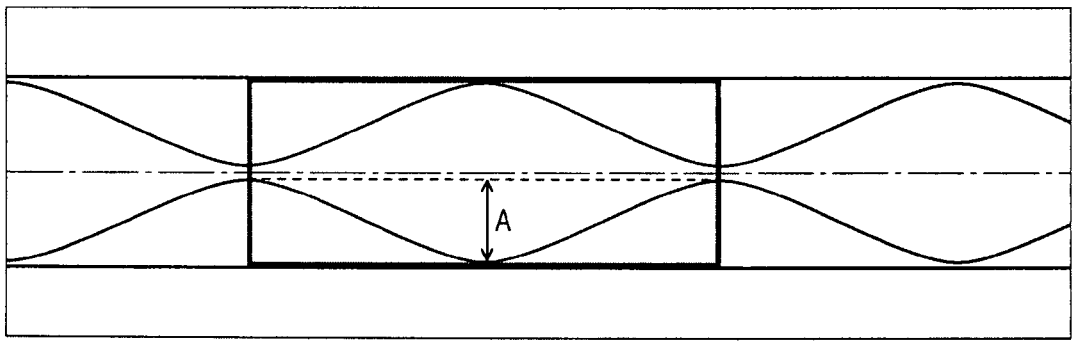
FIG. 23C is a cross-sectional view of a sinusoidal configuration with the wavelength equal to the container closure length with a large amplitude (A)
Figure 24A:
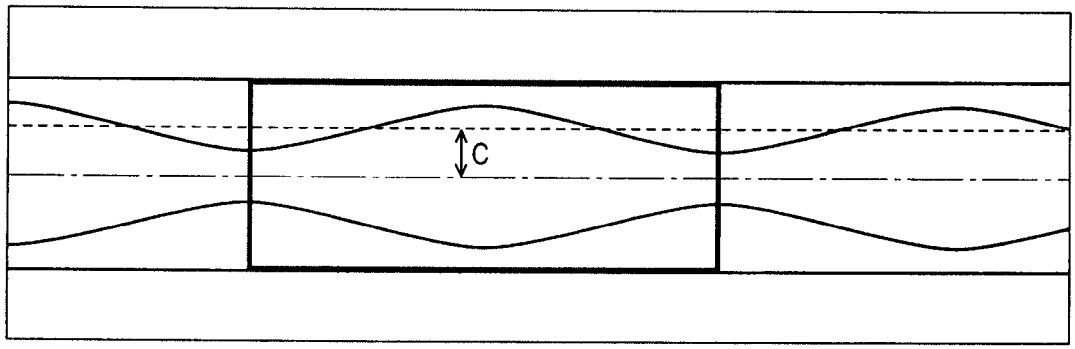
FIG. 24A is a cross-sectional view of a sinusoidal configuration with the wavelength equal to the container closure length with a medium distance (C) between sinusoid and container closure axis.
Figure 24B:
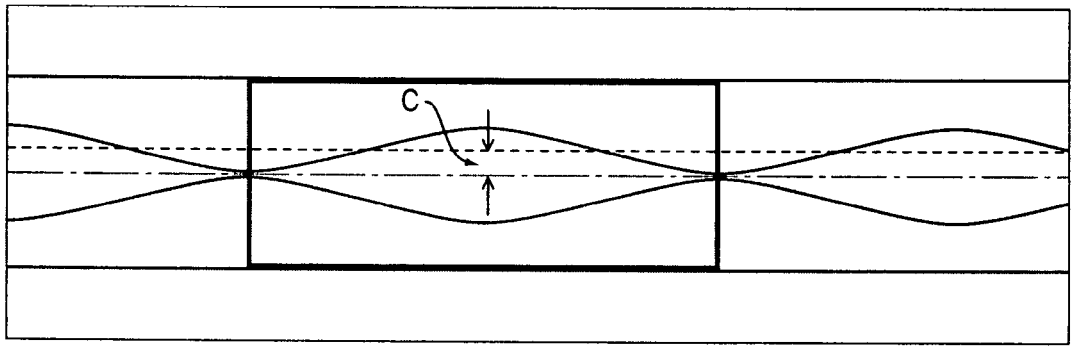
FIG. 24B is a cross-sectional view of a sinusoidal configuration with the wavelength equal to the container closure length with a small distance (C) between sinusoid and container closure axis.
Figure 24C:
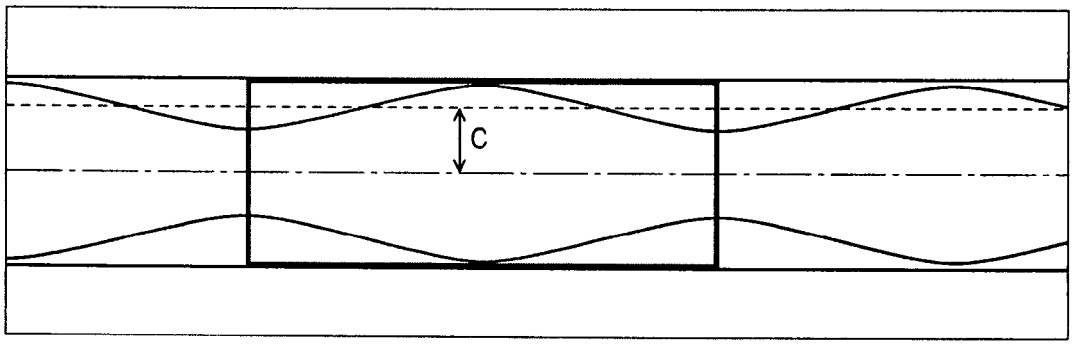
FIG. 24C is a cross-sectional view of a sinusoidal configuration with the wavelength equal to the container closure length with a large distance (C) between sinusoid and container closure axis.

FIG. 20 is a side perspective view of a container closure according to the invention in which the composition of the closure varies continuously longitudinally according to a sinusoidal function. In this example, container closure 100 has only a core layer 96. Core layer 96 has a composition 95A at ends 97 and 99 and another composition 95B in the middle 98, and in between varies gradually and in a continuous manner from a composition that is primarily composition 95A, to a composition that is primarily composition 95B, and then back to a composition that is primarily composition 95A. In the preferred embodiment, one composition 95A is a relatively pliable, relatively low bulk density foamed resin; and the other composition 95B is a resin significantly less pliable with a high bulk density, or composition could change from a foamed plastic at the ends to a dense, non-foamed plastic in the middle. In another embodiment, the chemical constituents of the compositions would change. The variation of composition preferably is according to a sinusoidal wave form. The container closure preferably is manufactured by extruding according to the sinusoidal wave form, and then cutting the extrusion into individual container closure lengths, with the wavelength of the sinusoidal wave form substantially equal to a length of the container closure apparatus, approximately equal to multiples of the length of the container closure apparatus, approximately equal to a sub-multiple of the length of the container closure apparatus, and combinations thereof.

Although the foregoing description is directed to the preferred embodiments of the invention, it is noted that other variations and modifications will be apparent to those skilled in the art, and preferably such variations and modifications can be made without departing from the spirit or scope of the invention. Moreover, any feature or features described in connection with one embodiment of the invention preferably can be used in conjunction with other embodiments, even if not explicitly stated above.

What is claimed as new and desired to be protected by Letters Patent of the United States is:

1. A container closure comprising: an inner core with a non-cylindrical profile; one or more outer layers concentrically surrounding said inner core; a first one of said one or more outer layers being adjacent said inner core and having an interface area with said inner core, said inner core and said one or more outer layers having different compositions; and wherein the outer profile of the combined inner core and the outer layers is substantially cylindrical; said container closure characterized by:

said inner core and said first one of said one or more outer layers being both present at every cross-section along the entire length of said closure;

said interface between said inner core and said first one of said one or more outer layers having a continuously smooth variation along the entire length of said closure; and wherein said inner core has an asymmetric longitudinal profile along the entire length of said container closure.

2. The container closure of claim 1 wherein at least one of said inner core and said outer layer comprise at least one thermoplastic resin.

3. The container closure of claim 2 wherein said at least one thermoplastic resin is selected from the group consisting of olefins, co-polymers of olefins, blends comprising olefins, and styrenics, co-polymers of styrenics, blends comprising styrenics, and combinations of the foregoing.

4. The container closure of claim 2 wherein said at least one of said thermoplastic resins is foamed.

5. The container closure of claim 1 wherein said container closure has a longitudinal cylindrical axis and wherein the composition of said inner core or at least one of said one or more outer layers varies longitudinally.

6. The container closure of claim 1 wherein said inner core and said outer layer are extruded.

7. The container closure of claim 1 wherein the cross-section of said inner core has a substantially sinusoidal longitudinal profile.

8. The container closure of claim 7 wherein a wavelength of said substantially sinusoidal longitudinal profile is selected from the group consisting of: substantially equal to the length of said container closure, substantially equal to multiples of the length of said container closure, substantially equal to a sub-multiple of the length of the container closure, and combinations thereof.

9. The container closure of claim 1 wherein said inner core has one or more maximum diameters at positions along the length of said container closure.

10. A container closure as in claim 1 wherein said container closure further comprises a first longitudinal portion having a first composition and a second longitudinal portion having a second composition.

11. A container closure as in claim 1 wherein the composition of said container closure varies continuously.

12. The container closure of claim 1 wherein said variable cross-section along the length of the container closure determines a radial compression and relaxation force profile along said closure length.

13. The container closure of claim 1 wherein said variable cross-section along the length of the container closure determines oxygen transmission levels through said closure.

* * * * *